US006585489B2

(12) United States Patent
Perella et al.

(10) Patent No.: US 6,585,489 B2
(45) **Date of Patent: *Jul. 1, 2003**

(54) FAN GRILL CONSTRUCTION

(75) Inventors: James B. Perella, West Chester, PA (US); Rodney Wilson, Jr., Boothwyn, PA (US); Michael Cichetti, West Chester, PA (US); Charles Litvin, West Chester, PA (US)

(73) Assignee: Lasko Holdings Inc., West Chester, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/949,543

(22) Filed: Sep. 10, 2001

(65) Prior Publication Data

US 2003/0049132 A1 Mar. 13, 2003

Related U.S. Application Data

(63) Continuation-in-part of application No. 09/828,673, filed on Apr. 9, 2001, now Pat. No. 6,454,537.

(51) Int. Cl.[7] ..... F04D 29/70
(52) U.S. Cl. ..... 416/247 R
(58) Field of Search ..... 416/247 R

(56) References Cited

U.S. PATENT DOCUMENTS

| | | | | |
|---|---|---|---|---|
| 2,950,859 | A | 8/1960 | Kirk | |
| 4,120,615 | A | 10/1978 | Keem et al. | |
| 5,118,252 | A | 6/1992 | Chaney | |
| 5,348,447 | A | 9/1994 | Redetzke | |
| D416,617 | S | * 11/1999 | Jane' et al. | D23/378 |
| 6,071,079 | A | 6/2000 | Litvin | |
| D427,674 | S | 7/2000 | Moreno | |
| 6,196,803 | B1 | 3/2001 | Hill et al. | |
| 6,309,192 | B1 | 10/2001 | Litvin | |
| 6,454,537 | B1 | * 9/2002 | Perella et al. | 416/247 R |

* cited by examiner

*Primary Examiner*—Edward K. Look
*Assistant Examiner*—Kimya N McCoy

(57) ABSTRACT

Improved fan grill/guard construction for fans for supplying air, where the fan has a front grill with an outer ring which wraps around and is dimensionally structured to improve airflow and to diffuse the air over a wide area.

37 Claims, 8 Drawing Sheets

50
A
B
C
D
51
55
59
69
70
71
72
73
75
90
AIR FLOW
AIR FLOW

FAN GRILL CONSTRUCTION

This application is a continuation-in-part of U.S. patent application Ser. No. 09/828,673 filed Apr. 9, 2001 now U.S. Pat. No. 6,454,537.

BACKGROUND OF THE INVENTION

1. Field of the Invention

This invention relates to an improved fan grill guard construction of the type where the grill has an outer ring, which is dimensionally structured to provide greater airflow and diffusion.

2. Description of the Prior Art

The typical grill used on the front of oscillating, pedestal or wall mount fans is of round wire, with some fans such as shown in U.S. Pat. No. 6,071,079 having a front grill of molded plastic. There are many advantages in using molded plastic grills, in that plastic does not rust, is inexpensive to mold and does not require welding or painting. In addition, plastic permits easy design variation to achieve a look that is less restrictive in the center, and allows the customer to see the blades.

Plastic grills can also be constructed so they do not require additional parts for assembly, such as rings or clips.

While the prior art Pat. No. 6,071,079, uses plastic grills, it is designed to provide a focused air pattern, which is not entirely satisfactory if used in an oscillating fan, as it results in an on-off air flow, which is not as desirable as a diffused air flow, which is obtained by the grill construction described herein.

SUMMARY OF THE INVENTION

It has now been found that an improved fan grill construction can be obtained for a front grill, which has an outer ring which is dimensionally structured so that the air flow is diffused instead of focused, resulting in an improved total air volume (NEMA CFM) over a larger area.

The principal object of the invention is to provide front grill construction for a fan that is dimensionally structured to provide increased air volume over a large area.

A further object of the invention is to provide fan grill construction that allows tighter spacing to the fan blade periphery to provide a more efficient package with improved safety.

A further object of the invention is to provide fan grill construction which adds mass to the outside of the grill to dampen vibration.

A further object of the invention is to provide a front grill which is constructed of molded plastic.

A further object of the invention is to provide fan grill construction that can be adapted to a variety of types and sizes of fans.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

It should, of course, be understood that the description and drawings herein are merely illustrative and that various modifications and changes can be made in the structures disclosed without departing from the spirit of the invention.

Like numerals refer to like parts throughout the several views.

The entire disclosure of U.S. patent application Ser. No. 09/828,673 filed Apr. 9, 2001 is incorporated herein by reference as if set forth in full.

DESCRIPTION OF THE PREFERRED EMBODIMENT

When referring to the preferred embodiment, certain terminology will be utilized for the sake of clarity. Use of such terminology is intended to encompass not only the described embodiment, but also technical equivalents which operate and function in substantially the same way to bring about the same result.

Figure 1:
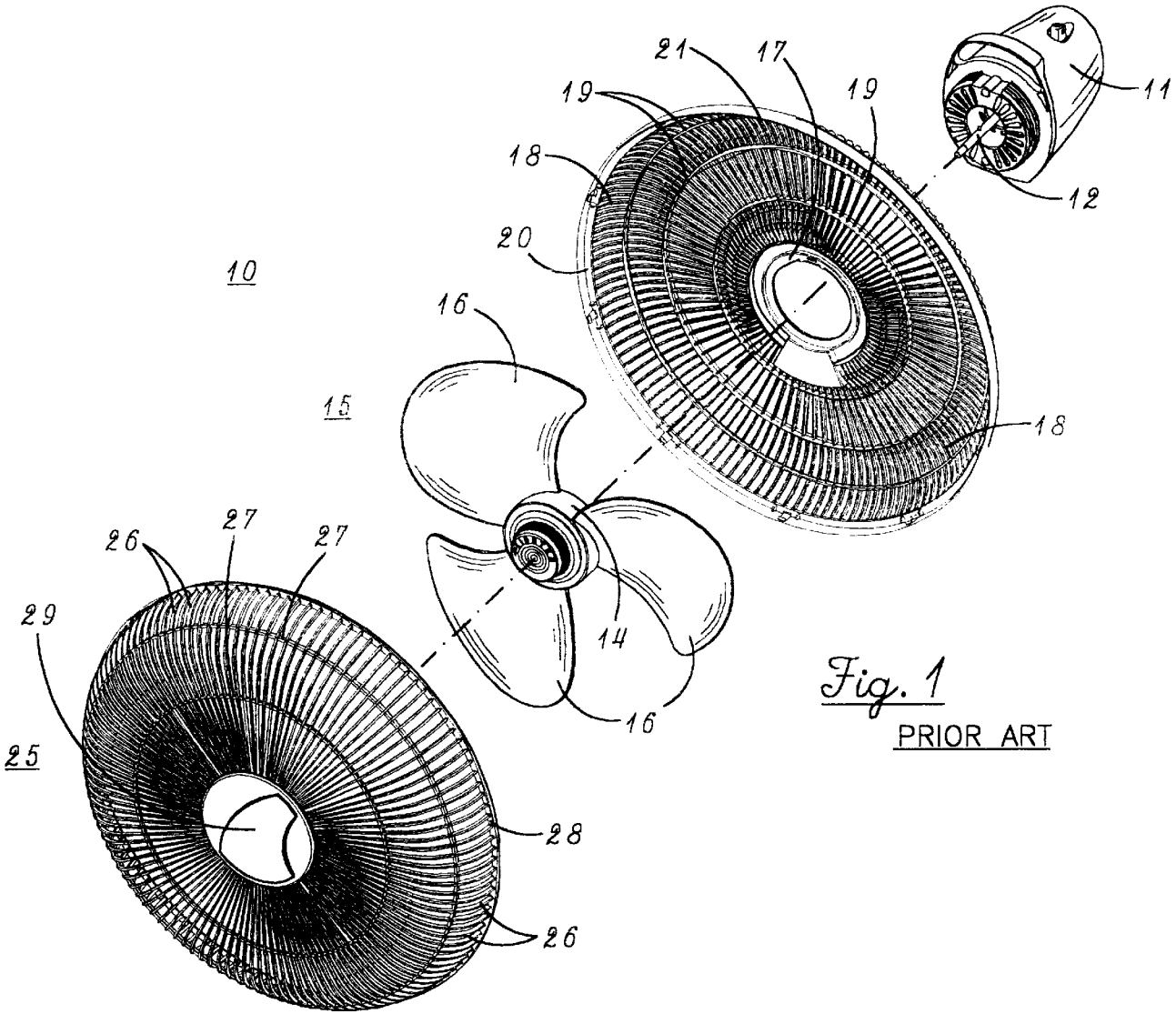
Fig. 1 PRIOR ART
FIG. 1 is an exploded perspective view of a prior art fan.
Figure 3:
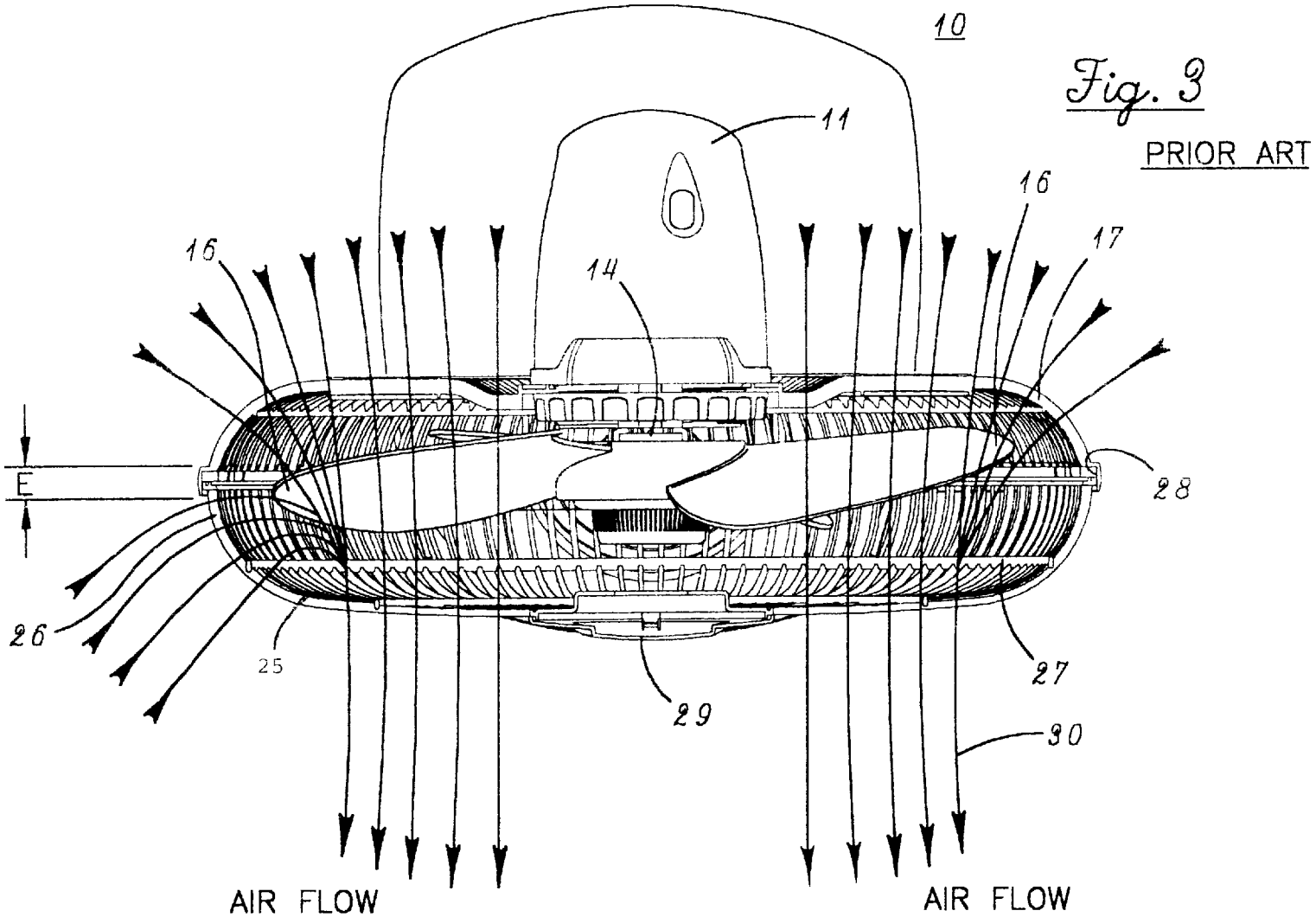
Fig. 3 PRIOR ART
FIG. 3 is a horizontal sectional view of the assembled prior art fan of FIG. 1.

Referring now more particularly to FIGS. 1 and 3 of the drawings, a typical prior art fan 10 is illustrated. The fan 10 includes an electric motor housing 11, which contains an electric motor (not shown) of well known type, which may be connected to a source of electrical power (not shown). The fan motor has an output shaft 12, with a hub 14 of a blade assembly 15 attached thereto, with three blades 16 being shown.

The fan motor housing 11 may be mounted to a yoke (not shown) which may be mounted to a pedestal (not shown) or other well known support structure, which can rest on the floor, on a table or otherwhere as desired. The housing 11 has a rear grill 17 mounted thereto, which is of circular configuration, with a plurality of spaced radial ribs 18, connected to a plurality of concentric rings 19, with the radial ribs 18 extending out to a circumferential rim 20 and inwardly to a center ring 21. A front grill 25 is provided, which has a plurality of spaced radial ribs 26, which are connected to a plurality of concentric rings 27. The ribs 26 extend out to an outer rim 28, which mates with rim 20 of rear grill 17.

The radial ribs 26 also extend inwardly and are connected to a center plate 29.

Both the front and rear grills 25 and 17 are preferably formed of molded plastic.

As shown in FIG. 3, the arrows 30 illustrate the airflow through the rear grill 17, and out the front grill 25 in a focused pattern, which upon oscillation provides the on-off airflow pattern that is not desirable.

Figure 2:
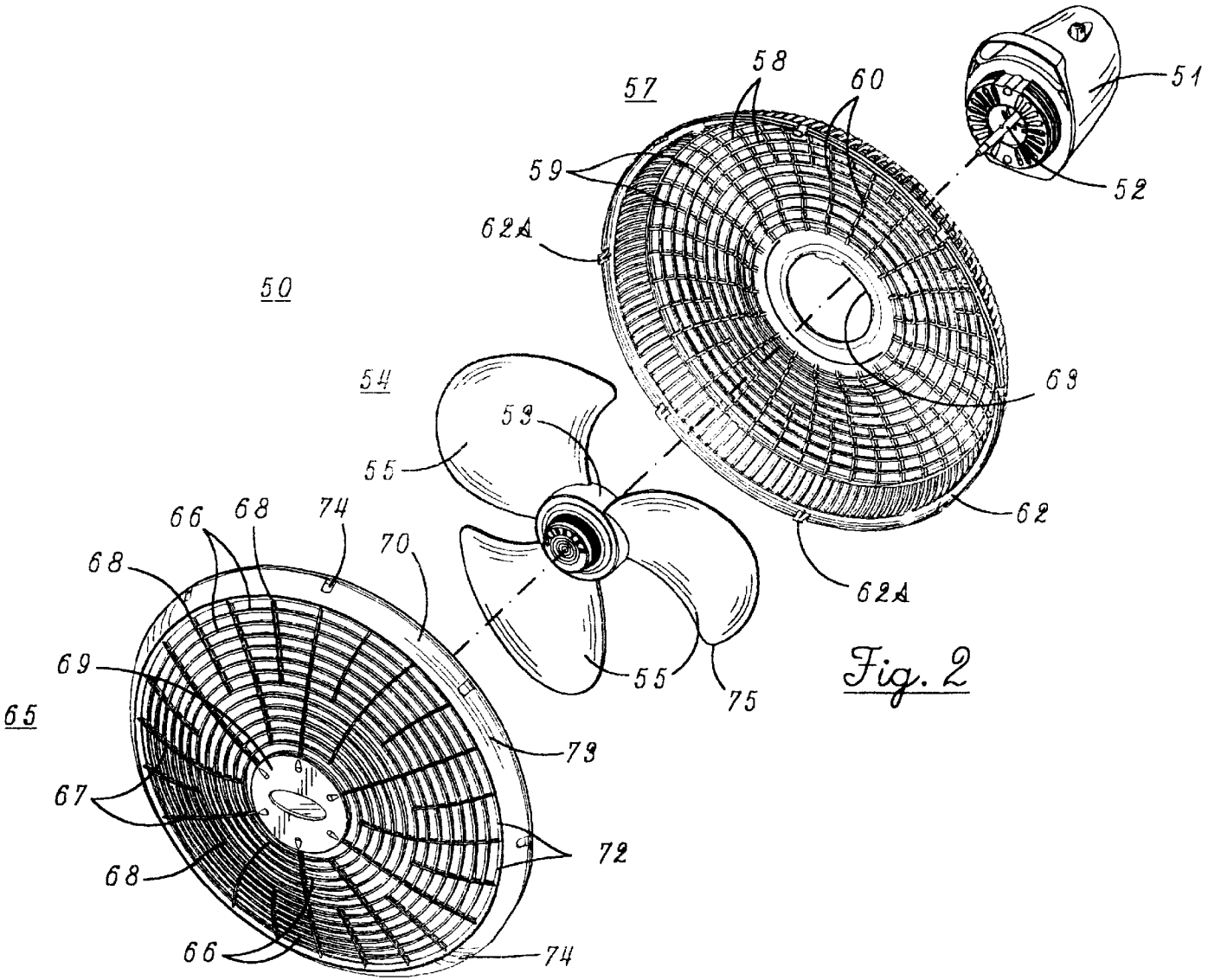
FIG. 2 is an exploded perspective view of a fan with the new front grill construction of the invention.
Figure 4:
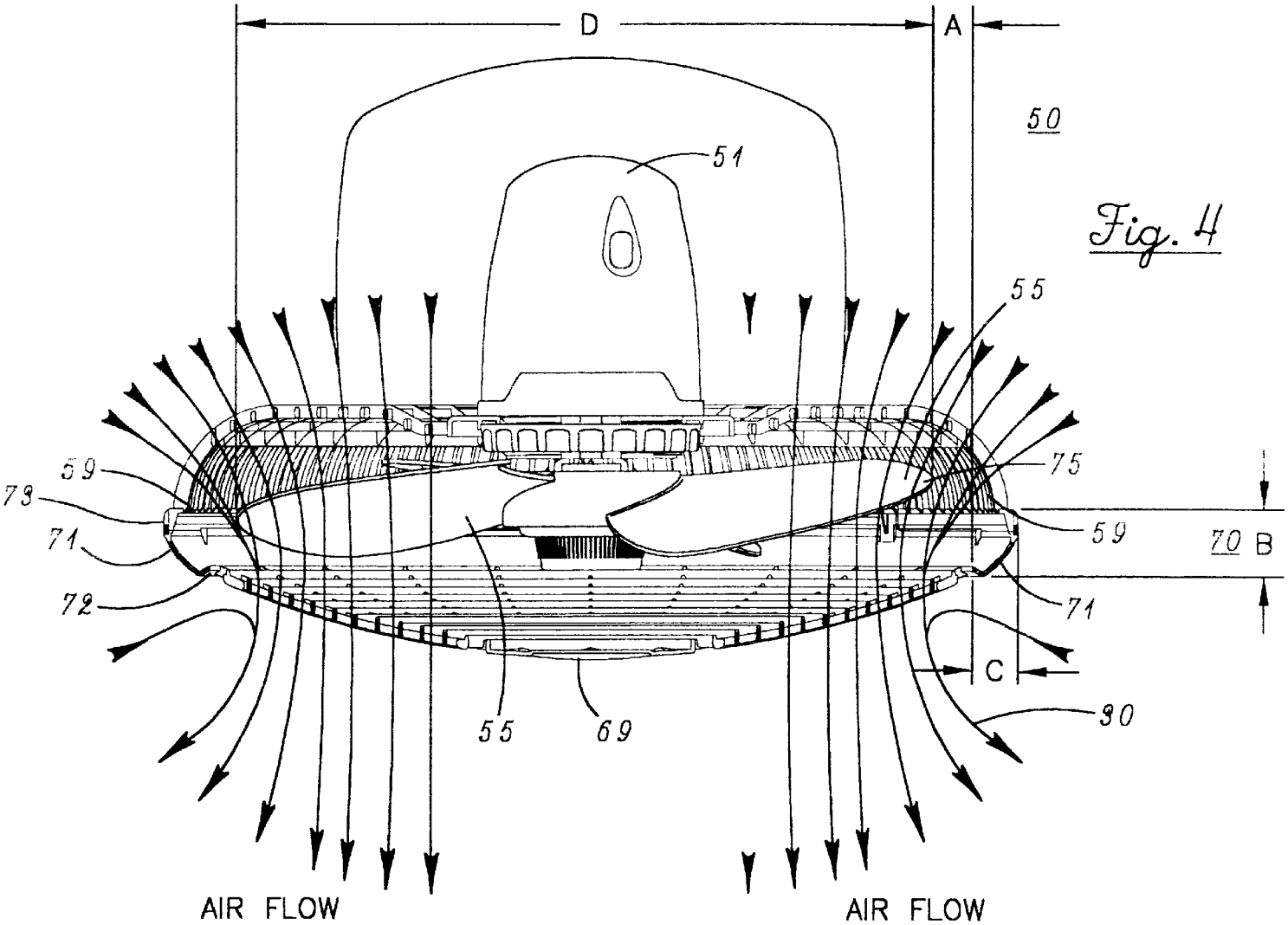
FIG. 4 is a view similar to FIG. 3, but showing the improved fan grill construction of the invention.

Referring now more particularly to FIGS. 2 and 4, the improved front grill constuction is therein illustrated, and as part of a fan 50.

The fan 50 includes an electric motor housing 51, which contains an electric motor (not shown) of well known type, which may be connected to a source of electrical energy (not shown). The fan motor has an output shaft 52, to which a hub 53 of a blade assembly 54 is attached, with the blade assembly having three blades 55.

The fan motor housing 51 may be mounted to a pedestal (not shown) or other structure as described for fan 10.

The motor housing 51 has a rear grill 57 mounted thereto in conventional manner such as by bolts (not shown).

The rear grill 57 has a plurality of concentric rings 58 to which spaced interrupted radial ribs 59 and 60 are connected. The ribs 59 are shorter than ribs 60 and extend out to a rim 62 of grill 57. The ribs 60 extend out to rim 62 and inwardly to a center ring 63 which is attached to motor housing 51.

A front grill 65 is provided, of circular configuration, with a plurality of concentric rings 66, which have a plurality of spaced radial ribs 67 and 68 connected thereto, with ribs 67 extending inwardly to a center plate 69, and outwardly to a ring 70 to be described.

The ribs 68 extend outwardly to ring 70, and inwardly short of plate 69.

The ring 70 preferably includes a curved panel 71, which extends inwardly to an inclined panel 72, and outwardly to a rim 73. The rim 73 mates with rim 62 of grill 57, with spaced tabs 62A therearound, which are engaged with slots 74 in rim 73 to retain the grills 57 and 65 together.

In FIG. 4, the ring dimensions are indicated by the letters A, B, C and D. The dimension A is the distance from the tip 75 of a blade 55 to the inside diameter of the ring 70. The dimension B is the depth of ring 70, or the distance from the rear most portion of rim 73 to the front end of panel 71. The dimension C is the width of ring 70. The dimension D is the diameter of the blade assembly 54.

The dimensions A, B, C and D for the fin 50 in the preferred embodiment for a 16 inch fan with blade diameter D=16 inches, are A=0.170 inches, B=1.41 inches and C=0.95 inches.

The dimensions A, B, and C for oscillating fans with a typical blade diameter from 10 to 30 inches, with D as an initial dimensional base point, have the dimensions calculated as follows; where the range of A is +/−40% of D as measured from tip 75, B=0.60 to 4.5 inch, and C=40 to 200% B.

It has been found by testing that a 16 inch fan 50 with a front grill 65, compared to a prior art 16 inch fan 10 with front grill 25, provides significant improvement.

The fan 50 on high speed at 9 feet from the fan provided an air velocity (NEMA CFM) of 5710.00, whereas fan 10 provided an air velocity (NEMA CFM) of 4737.10.

Figure 5:
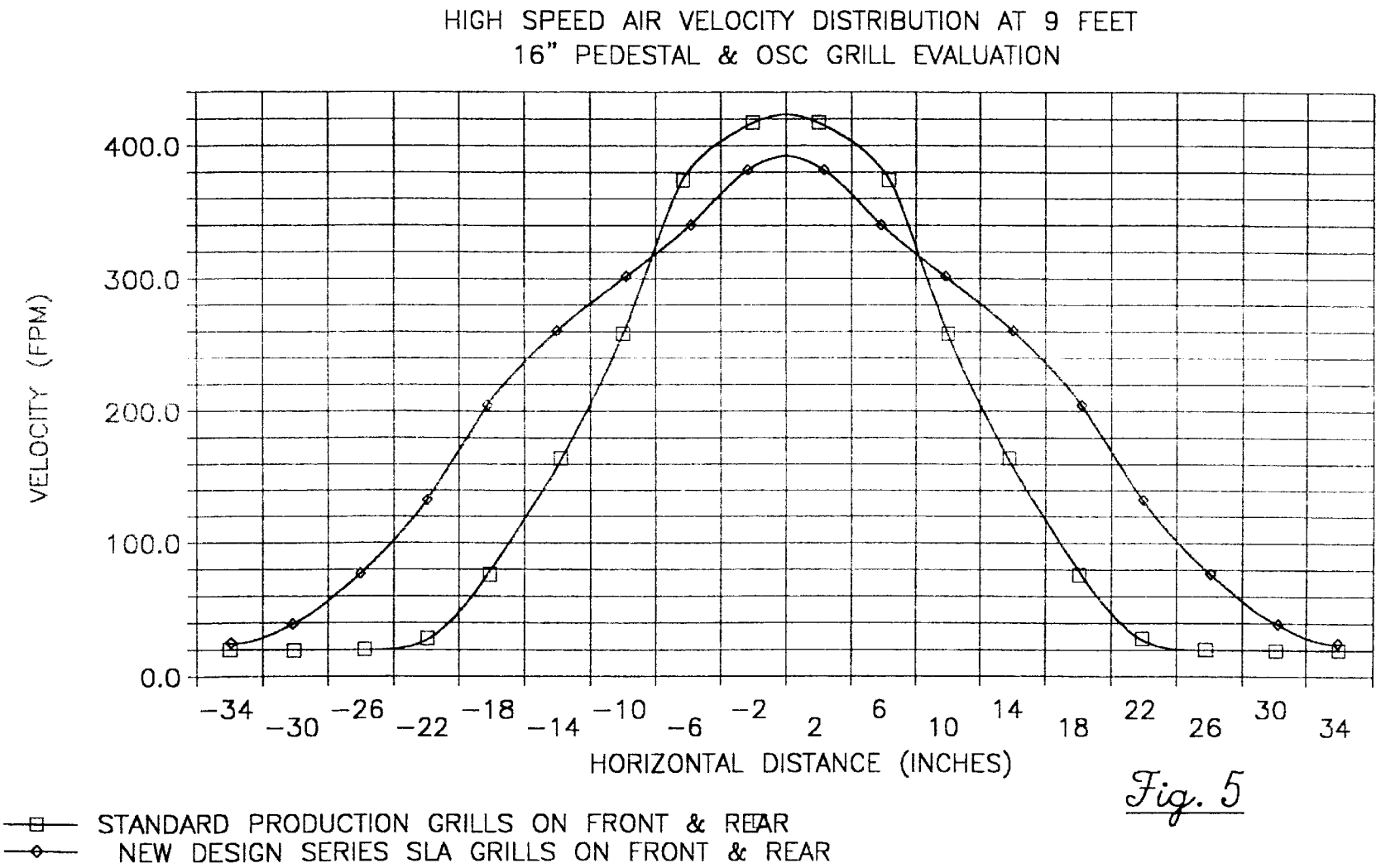
FIG. 5 is a graph comparing the performances of the prior art fan grill construction to the improved fan grill construction of the invention.

Referring to FIG. 5 tests were run on two fans comparing the fans 10 and 50 with measurements at horizontal distances to 34 inches on each side. The results were plotted which shows significantly greater air velocities over distance for fan 50 with the improved front grill construction.

Figure 6:
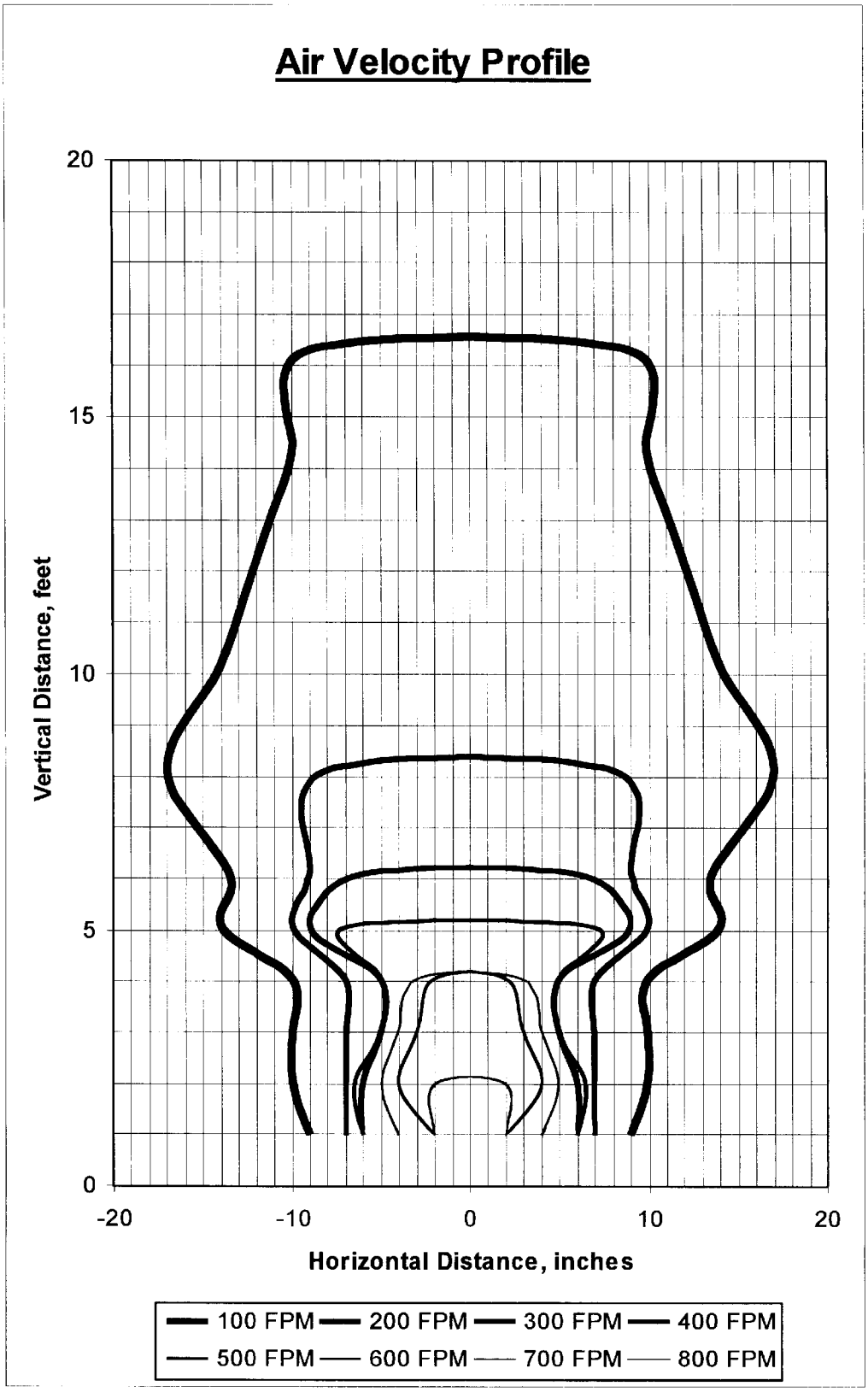
FIG. 6 is a graph of the air velocity profile of prior art fan grills.
Figure 7:
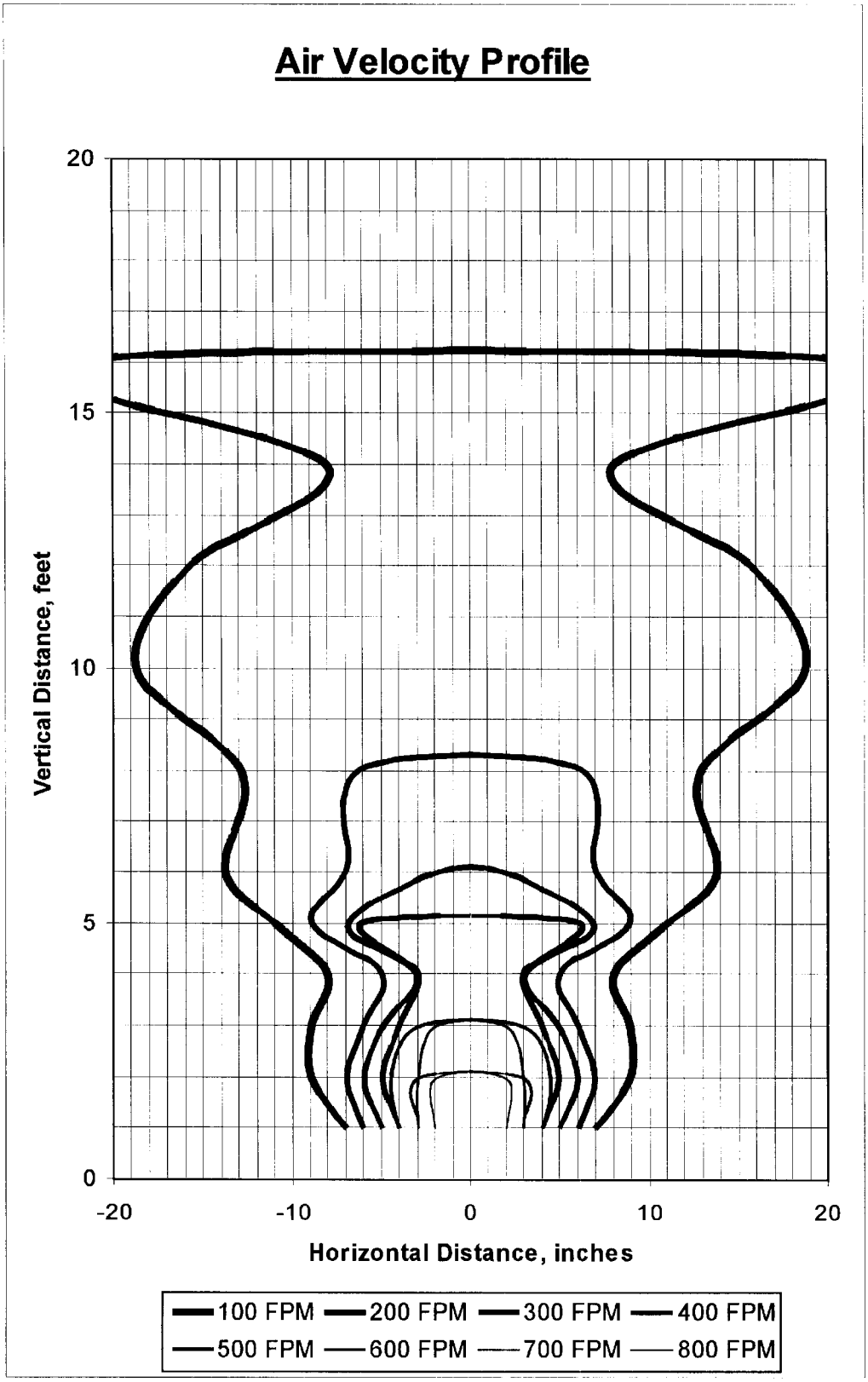
FIG. 7 is a graph of the air velocity profile for a fan with a plastic rear grill and an improved plastic front grill, and, FIG. 8 is a graph of the air velocity profile of a fan having a different plastic rear grill and the improved plastic front grill.
Figure 8:
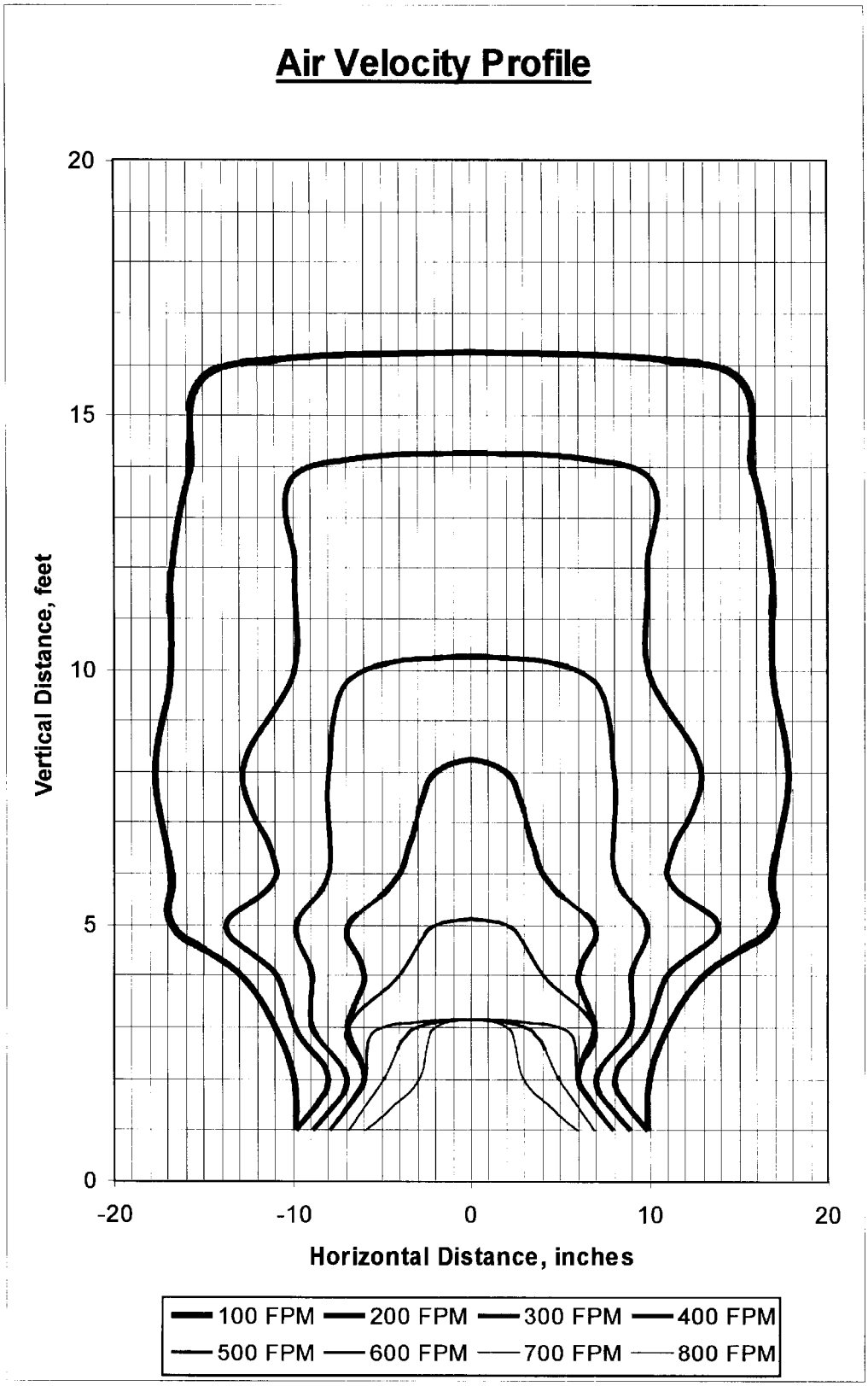

Referring to FIGS. 6, 7 and 8 the air velocity profiles for fans having. different front and rear grills were plotted, which shows that the improved front fan grill construction provided a significantly wider air flow pattern than the conventional grills.

It will thus be seen that an improved fan grill construction has been provided with which the objects of the invention are achieved.

We claim:

1. In combination with an oscillating fan, which fan has a rear grill, a front grill attached to said rear grill, a fan motor external to said rear grill, to which the rear grill is mounted, a fan blade assembly attached to and driven by said fan motor, the improvement comprising, said front grill having a plurality of ribs, said ribs being connected to a circumferential ring, said circumferential ring having a panel to which said ribs are connected, said circumferential ring dimensions are determined by a fan blade assembly diameter D, which dimensions include a dimension A, which is a distance from the tips of the fan blades to an inside diameter of said circumferential ring, a dimension B which is a depth of the ring, and a dimension C which is a width of the ring, said dimensions being in the range of a is plus or minus 40% of D, B equals 0.60 to 4.5 inches and C equals 40 to 200% of B.

2. A fan as defined in claim 1 in which

D is 16 inches, A is 0.170 inches, B is 1.41 inches and C is 0.95 inches.

3. A fan as defined in claim 1 in which said front grill is of molded plastic.

4. A grill according to claim 1, wherein said grill provides a diffuse airflow from said fan.

5. A grill according to claim 1, wherein said circumferential ring further comprises an inclined panel extending from a front portion of said circumferential ring toward a center of said fan.

6. A front grill for use with a fan having a motor and a blade assembly, said grill comprising:

a circumferential ring at an outer periphery of said grill, said circumferential ring having:

i) an inner diameter edge spaced away from a tip of said fan blade assembly by a dimension A, where A is less than about 40% of a diameter D of said fan blade, ii) a depth having a dimension B, and iii) a width having a dimension C, wherein said dimension B is between about 0.60 and 4.50 inches, said dimension C is between about 40% to 200% of dimension B, and said inside edge of said circumferential ring establishes a clearance from said fan blade tip by said dimension A.

7. A grill according to claim 6, wherein said grill provides a diffuse airflow from said fan.

8. A grill according to claim 6, wherein said grill provides an increased air volume over a predetermined area.

9. A grill according to claim 6, wherein said fan is an oscillating fan.

10. A grill according to claim 6, wherein said fan is a table mounted fan.

11. A grill according to claim 6, wherein said fan is a floor mounted fan.

12. A grill according to claim 6, wherein said grill dampens a vibration of said fan based on a mass of said grill.

13. A grill according to claim 6, further comprising a plurality of attaching means for coupling said grill to a portion of said fan.

14. A grill according to claim 13, wherein said attaching means is a plurality of slots formed in said circumferential ring.

15. A grill according to claim 6, wherein said grill is mounted on a front portion of said fan such that air circulated by said fan blade exits through said grill.

16. A grill according to claim 6, wherein said circumferential ring substantially reduces re-circulation of air through a front of said grill.

17. A grill according to claim 6, further comprising a rear grill coupled to said front grill and wherein said motor is mounted external to said rear grill.

18. A grill for use with a fan having a motor and a blade, said grill comprising:

a circumferential ring at an outer periphery of said grill, said circumferential ring having:

i) an inner diameter edge spaced away from a tip of said fan blade by a dimension A, where A is less than about 40% of a diameter D of said fan blade, ii) a depth having a dimension B, and iii) a width having a dimension C, wherein said dimension B is between about 0.60 and 4.50 inches, said dimension C is between about 40% to 200% of dimension B, and said inside edge of said circumferential ring establishes a clearance from said fan blade tip by said dimension A and wherein said grill provides a diffuse airflow from said fan.

19. A grill according to claim 18, wherein said circumferential ring further comprises an inclined panel extending from a front portion of said circumferential ring toward a center of said fan.

20. A grill according to claim 18, wherein said grill is a plurality of grills, a first one of said plurality of grills mounted on said fan motor on a front portion thereof, such that air circulated by said fan blade enters through said first grill, and a second one of said plurality of grills mounted on a front portion of said first grill such that air circulated by said fan blade exits through said second grill.

21. A grill for use with a fan having a motor and a blade, said grill comprising:

a circumferential ring at an outer periphery of said grill, said circumferential ring having:

i) an inner diameter edge spaced away from a tip of said fan blade by a dimension A, where A is less than about 40% of a diameter D of said fan blade, ii) a depth having a dimension B, and iii) a width having a dimension C, wherein said dimension B is between about 0.60 and 4.50 inches, said dimension C is between about 40% to 200% of dimension B, and said inside edge of said circumferential ring overlays a portion of said fan blade by said dimension A.

22. A grill according to claim 21, wherein said grill provides a diffuse airflow from said fan.

23. A grill according to claim 21, wherein said grill provides an increased air volume over a predetermined area.

24. A grill according to claim 21, wherein said fan is an oscillating fan.

25. A grill according to claim 21, wherein said fan is a table mounted fan.

26. A grill according to claim 21, wherein said fan is a floor mounted fan.

27. A grill according to claim 21, wherein said grill dampens a vibration of said fan based on a mass of said grill.

28. A grill according to claim 21, further comprising a plurality of attaching means for coupling said grill to a portion of said fan.

29. A grill according to claim 28, wherein said attaching means is a plurality of slots formed in said circumferential ring.

30. A grill according to claim 21, wherein said grill is mounted on a front portion of said fan such that air circulated by said fan blade exits through said grill.

31. A grill according to claim 21, wherein said circumferential ring substantially reduces re-circulation of air through a front of said grill.

32. A grill according to claim 21, wherein said grill is a plurality of grills, a first one of said plurality of grills mounted on said fan motor on a front portion thereof, such that air circulated by said fan blade enters through said first grill, and a second one of said plurality of grills mounted on a front portion of said first grill such that air circulated by said fan blade exits through said second grill.

33. A grill according to claim 21, further comprising a rear grill coupled to said grill and wherein said motor is mounted external to said rear grill.

34. A grill according to claim 21, wherein said circumferential ring further comprises an inclined panel extending from a front portion of said circumferential ring toward a center of said fan.

35. A grill for use with a fan having a fan blade, said grill comprising:

a circumferential ring at an outer periphery of said grill, said circumferential ring having:

i) an inside edge spaced away from a tip of said fan blade by a dimension A, where A is less than about 40% of a diameter D of said fan blade, establishing a clearance between said fan blade tip and said inside edge of said circumferential ring, ii) a depth having a dimension B, and iii) a width having a dimension C, wherein said dimension B is between about 0.60 and 4.50 inches, and said dimension C is between about 40% to 200% of dimension B.

36. An oscillating fan having a rear grill, a front grill attached to said rear grill, a fan motor external to the rear grill, to which the rear grill is mounted, a fan blade assembly attached to and driven by said fan motor, the front grill comprising:

a circumferential ring at an outer periphery of said front grill, said circumferential ring having:

i) an inside edge spaced away from a tip of said fan blade assembly by about 0.170 inches, establishing a clearance between said fan blade tip and said inside edge of said circumferential ring, ii) a depth of about 1.41 inches, and iii) a width of about 0.95 inches, wherein said front grill provides a diffuse airflow from said fan.

37. A grill according to claim 36, wherein said fan is one of a table mounted fan and a floor mounted fan.

* * * * *